United States Patent [19]

Wagner

[11] 4,409,918

[45] Oct. 18, 1983

[54] ICE-BREAKING AND CONVEYING SYSTEM

[76] Inventor: Jacob C. Wagner, 1042 S. Du Pont Hwy., New Castle, Del. 19720

[21] Appl. No.: 326,897

[22] Filed: Dec. 2, 1981

[51] Int. Cl.[3] ..... B63B 35/08

[52] U.S. Cl. ..... 114/40; 406/77

[58] Field of Search ..... 114/40–42; 37/45, 59–62, 58; 299/9, 24; 406/77, 81, 180, 190, 194

[56] References Cited

U.S. PATENT DOCUMENTS

| | | | |
|---|---|---|---|
| 230,072 | 7/1880 | Sears | 37/59 |
| 499,296 | 6/1893 | Kruisbrink et al. | 114/42 |
| 2,804,272 | 8/1957 | Montgomery | 299/9 |
| 3,667,416 | 6/1972 | Fioravanti et al. | 114/42 |
| 3,913,511 | 10/1975 | Weiland | 114/42 |

FOREIGN PATENT DOCUMENTS

| | | | |
|---|---|---|---|
| 58217 | 1/1891 | Fed. Rep. of Germany | 114/42 |
| 823995 | 11/1959 | United Kingdom | 406/77 |
| 147468 | 10/1968 | U.S.S.R. | 114/42 |
| 540767 | 1/1977 | U.S.S.R. | 114/40 |

*Primary Examiner*—Trygve M. Blix
*Assistant Examiner*—Stephen P. Avila
*Attorney, Agent, or Firm*—John F. McClellan, Sr.

[57] ABSTRACT

A shipborne system for clearing a channel through ice comprises in combination with a prow-mounted ice-breaker shape, a giant siphon including an intake leading to an upward passage which inclines to the rear so that ice blocks taken into it at the bow float upwardly and rearwardly where they are discharged, either laterally or over the stern, leaving a broken channel behind the ship for passage of other ships; discharge provisions include underwater discharge and trap-chamber above.

8 Claims, 5 Drawing Figures

ICE-BREAKING AND CONVEYING SYSTEM

FIELD OF THE INVENTION

This invention relates generally to icebreaking vessels and particularly to a ship which relocates broken ice from ahead of it to a position clear of the ship.

BACKGROUND OF THE INVENTION

An urgent problem still facing the United States is that of creating and maintaining ship channels through pack ice sufficient for economical shipboard transport of oil. On the Great Lakes there is need for all-year transport by ship, but now available. Experience with very large icebreakers such as the Manhattan defines the problem as: (1) not so much that of breaking the ice but instead of removing the ice broken so that the broken ice does not wedge the sides of the ship between unbroken ice bounding the channel and so that the icebreaker smash is cleanly against yet-to-be broken ice rather than against an energy absorbing cushion of floating ice blocks caught in the channel between ship and ice pack, and (2) that of leaving an unobstructed or broken and slow-to-freeze channel to the rear for other ships to follow.

OBJECTS OF THE INVENTION

The present invention although not actually reduced to practice in a vessel is intended to solve both problems and particularly to provide in an embodiment means of clearing broken ice from a ship-made channel through pack ice regardless of depth of water beyond that necessary to float the vessel and break the ice. A rough model demonstrating the principle has been made and tested.

Other objects of the invention are to provide a system as described which can funnel and tunnel ice to the rear, which is size adaptable, is semi-automatic in operation in the preferred embodiment, is rugged and simple in design, is economical to operate, and which to a considerable extent employs motion and trim of the vessel itself in operating the system.

BRIEF SUMMARY OF THE INVENTION

In brief summary given as cursive description only and not as limitation the invention includes in combination with a vessel which may have any suitable means for breaking ice mounted at the bow, including an ice-overriding scoopbow, a bow intake opening beneath the water for receiving ice broken, an upwardly inclined floating conveyance passage leading rearwardly from the bow intake opening for float-conveyance of broken ice rearwardly, and means for discharging ice from the floating-conveyance passage in a location preferably but not necessarily clear of the wake, and without sufficient loss of fluid to destroy the floating-conveyance action.

BRIEF DESCRIPTION OF THE DRAWINGS

The above and other objects and advantages of the invention will become more readily apparent on examination of the following description, including the drawings in which like reference numerals refer to like parts.

DETAILED DESCRIPTION OF THE DRAWINGS

Figure 1:
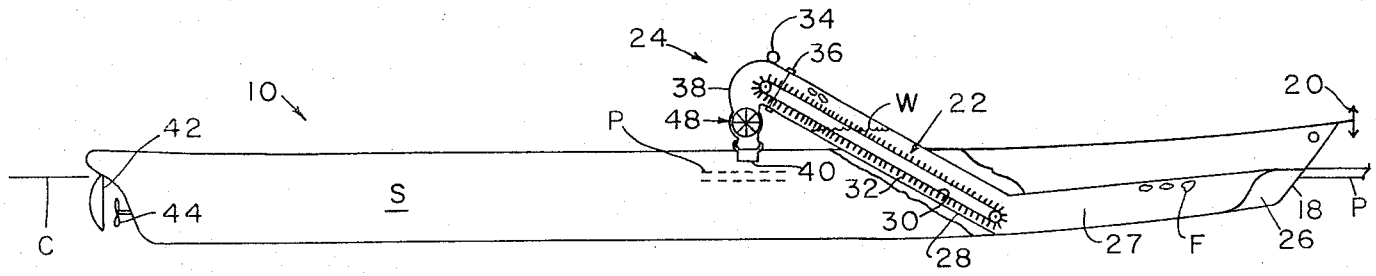
FIG. 1 is a side elevational sectional diagram of a first embodiment.

FIG. 1 diagrams the invention in embodiment 10 as part of an icebreaker ship S cleaning an ice-free channel C through pack ice P.

The ice may be broken by any suitable icebreaker represented by arrow 20, such as a conventional but large bow-mounted pneumatic chipping hammer. Preferably, however, the ice breaking may be done in the manner of the ship Manhattan by pressure on the ice of a sled-like, over-riding, overhanging bow 18, with incline deeper rearwardly.

Although the ship fills the channel broken, the ice fragments F are floated rearwardly in twin submerged open-bottom tunnels, then float up and are raised on a conveyor 22 and discharged over respective sides of the ship by means of a siphon system 24 with directional dry discharge. At the bow, forward motion of the ship forces the broken ice into the tunnel opening 26 in the bow centerline below the water. The tunnel may be tapered, as shown, in shape.

Connecting with each respective tunnel 27 on each side of the ship is a water filled straight first tubular portion 28 of the siphon system, fixed in the ship in an upwardly incline to the rear. In this, the ice fragments float upwardly and to a position above the deck, assisted by the conveyor 22 which is an endless chain 30 with a plurality of equally spaced arms 32, and which extends from below the water at a respective tunnel to above the water level at the top. The water level is drawn thirty feet above sea level by a vacuum pump 34, if desired.

The first tubular portion of each siphon system connects through a conventional fluid-tight rotary joint 36 with a laterally-inclined downward second tubular portion 38 which terminates in a discharge end 40 above the water and below a trap chamber 48. The ice fragments drop down the second tubular portion through the trap chamber and out the discharge end above the level of the pack ice on either side of the channel broken, where they are out of the way.

The diameter of the tubular portions may be fifteen feet (4.4 m) if desired, or larger.

Conventional icebreaker-ship rudder structure 42 and propellor structure 44 may be used.

Figure 2:
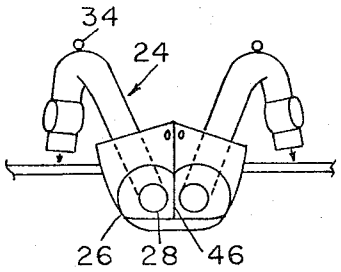
FIG. 2 is a front-view diagram of the first embodiment.

FIG. 2 shows in bow view the siphon system 24 with the appearance of the symmetrically paired tunnels 26 and corresponding first tubular portions 28, one on either side with the intakes located centrally and with a downward sharp fin 46 between to help break the ice.

Figure 3:
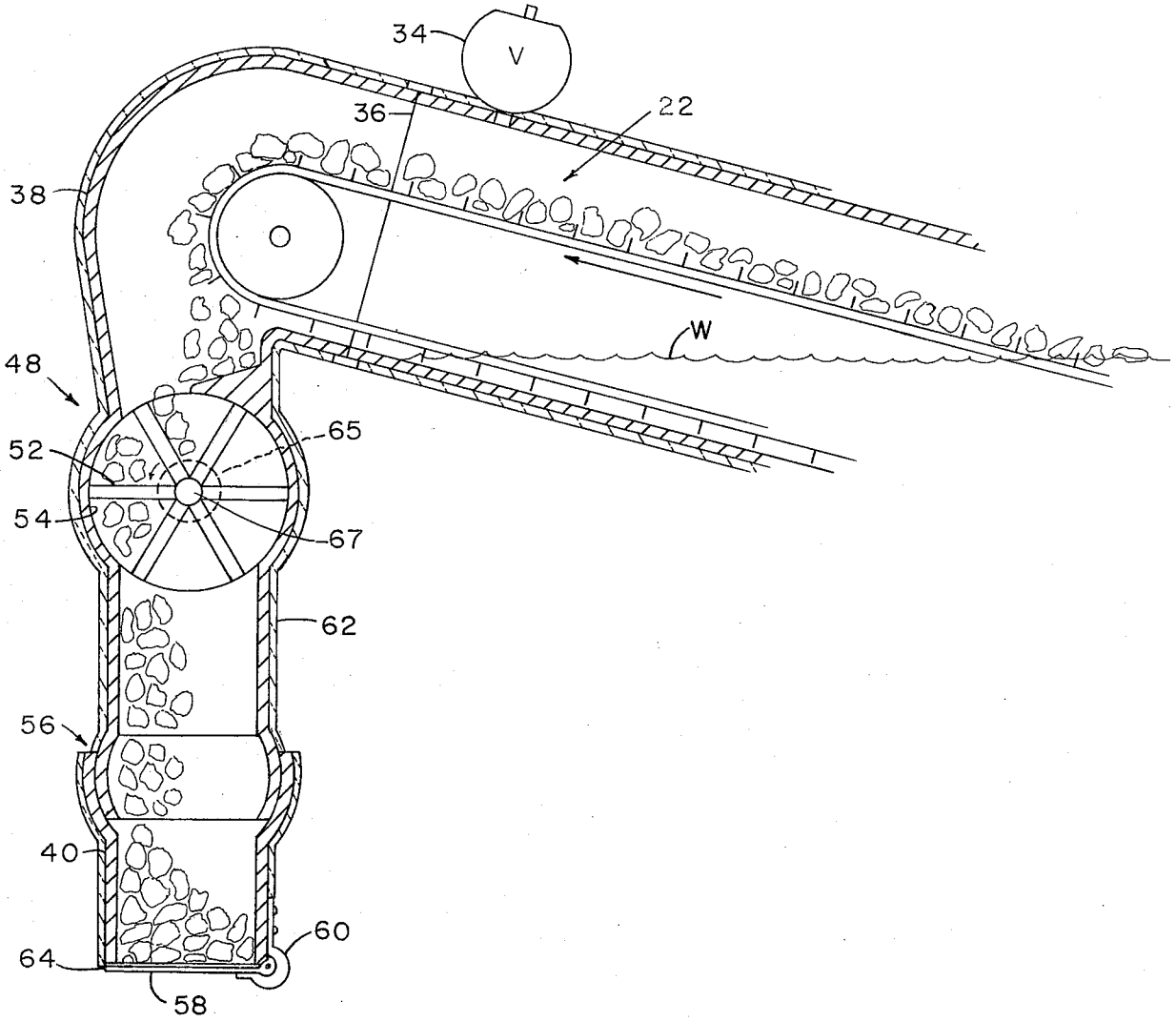
FIG. 3 is a side elevational sectional detail of the discharge end of the first embodiment.

FIG. 3 details the vacuum lock or trap chamber mechanism 48 for use in the embodiment 10 to permit discharge of broken ice onto the top of the ice pack while preserving the float conveyance feature of the invention.

The conveyor 22 dumps ice particles downward into and through a rotary air lock 48 similar to a positive displacement pump in having a plurality of close-fitting vanes 52 filling a curved cell 54 surrounding enough vanes to preserve hermetic compartmentation between the upwardly inclined and the vertical tubing sections.

The air lock pumps in a small quantity of air each time a vane clears the housing in upward motion but this is compensated by the vacuum pump 34 which holds the water level at "A" or other selected level.

A motor 65 fixed to the housing with the motorshaft coupled to the airlock pivot 67 may be used to rotate the air lock, or gravity alone may be used, the weight of the pieces of ice ejecting them downwardly.

The discharge end or exit tube 40 which may be curved and may be of any suitable length may adjustably incline to various downward directions by means of a conventional ball joint 56 so that ice can be dumped near or far from the sides of the vessel, as desired.

An anti-cold exit flap 58 biased closed by a spring 60 may be employed. The entire apparatus may be conventionally heated by a steam jacket and may have insulation throughout as indicated by the fragment at 62.

Characteristics of this embodiment include the provision that the discharge end 40 of the second tubular portion 38 is above the level of the water and pack ice on either side of the ship, for dry discharge; exit flap 58 may have a gasket 64 to help reduce leakage into the vacuum.

Figure 4:
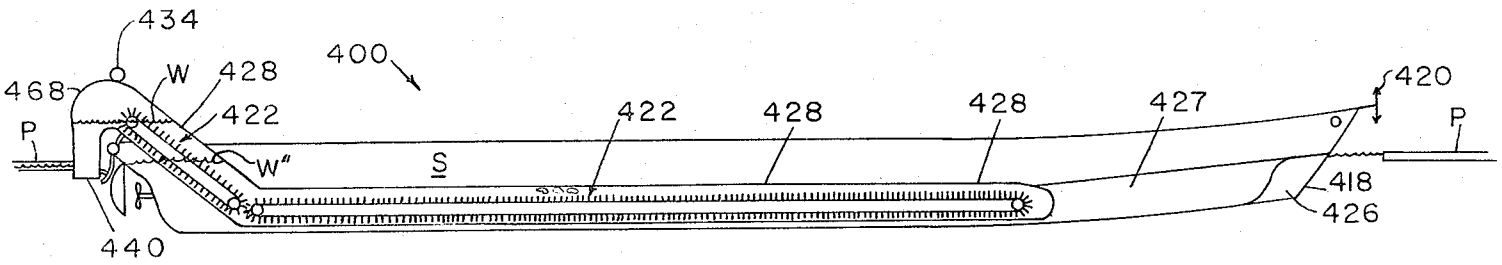
FIG. 4 is a side elevational sectional diagram of a second embodiment.

FIG. 4 diagrams an embodiment 400 with wet discharge which also employs vacuum-raised water level to float ice; it can employ full or partial vacuum. As in the first embodiment a ship S can carry a front mounted ice breaker 420 diagrammed as before. A tube 428 leads rearwardly from a below-water entrance 426 at the end of tunnel 427 of the scoop or sled bow 418 and connects under water to a discharge end 440 at the stern end through a straight length of tubing 428' which ends in a hook-shaped portion 468 rising over the stern and descending into the water. Water level W' may be at a maximum height maintainable by a vacuum pump 434 in the tube near the highest point, or may be lower as at W" depending on desired operation.

An endless conveyor which may have two flights, at 422, 428' and which may be of any conventional, powered type suitable for the purpose, carries broken ice upwardly adjacent the entrance, then on a level toward the rear, then up at 428' and dumps past 468, down and out the discharge end 440 at the rear for underwater discharge where it then floats away in the wake of the ship, unloaded by the press of ice above and by forward motion of the ship. A conventional conveyor vibrator may be used to keep the ice particles moving. The conveyor may have two flights, the second indicated at 422'.

Figure 5:
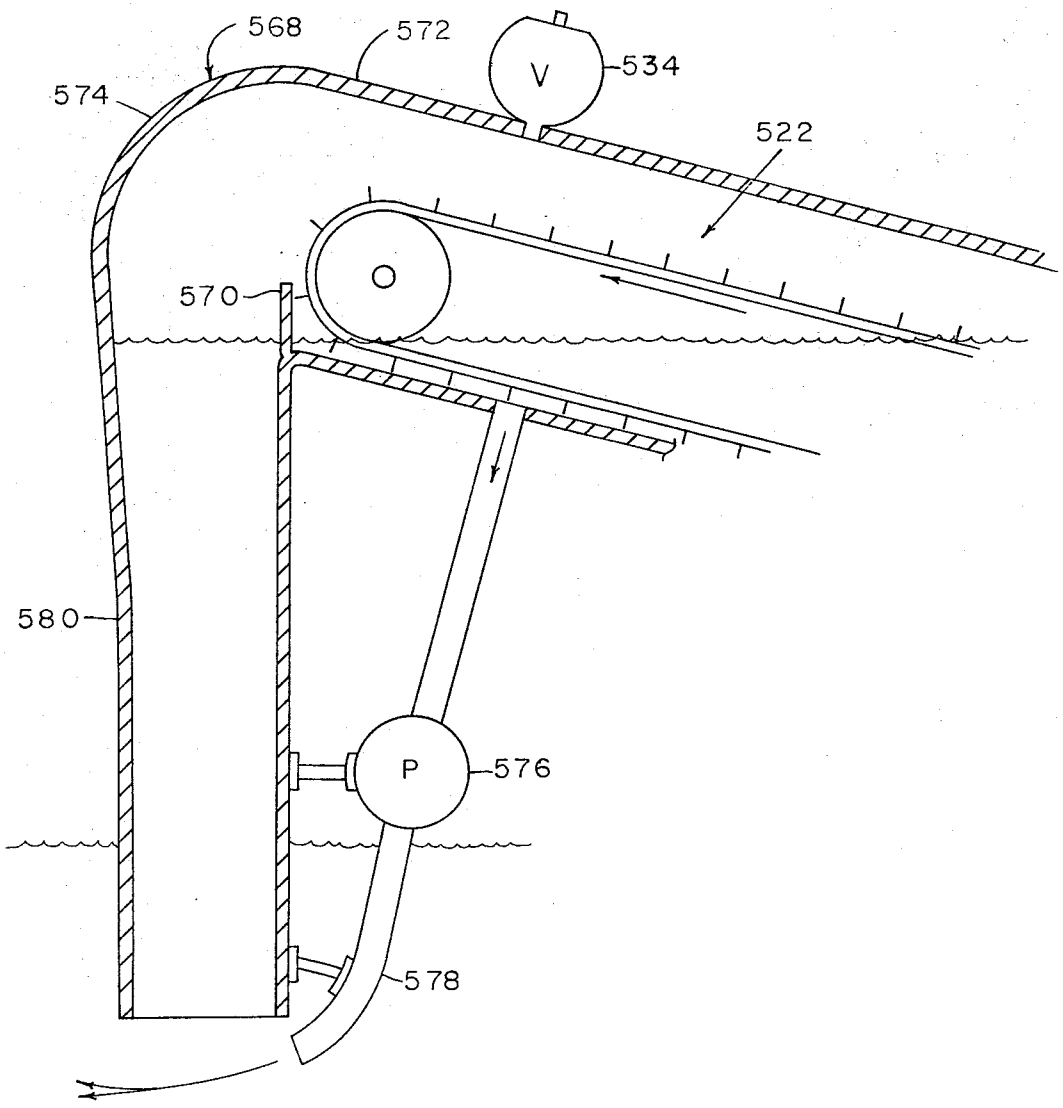
FIG. 5 is a side elevational sectional detail of a third embodiment.

FIG. 5 diagrams a detail of a further embodiment 500 similar to the last but with transverse vertical barrier or partition 570 dividing the lower portions of the tubular hook shape 568 into forward portion 572 and rearward portion 574, and shows a water pump 576 connected to pump water from the forward portion ahead of the transverse vertical barrier 570 and discharge the water towards the stern through tube 578. This action pulls the ice fragments rearwardly and adds a jet effect to ship propulsion, while barrier 570 prevents water from being pumped from the stern portion 574 of the tubing. The conveyor 522, here also diagrammed as an endless belt conveyor, picks up ice fragments piled up at the rear and dumps them down to similar underwater discharge. It is evident that the jet of water at 578 from the pump can help remove ice from the area of discharge from tube 580 by lowering pressure and by striking ejected particles of ice.

Obviously this invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for icebreaking for water navigation having: a ship with bow and stern, means for breaking ice at the forward part of said ship, means for preventing broken ice from impeding progress of said ship, including: means for conveying broken ice rearwardly in said ship, and means for discharging rearwardly conveyed broken ice from said ship, the improvement comprising the combination of said means for conveying broken ice including: means for floating broken ice within the ship in the form of a tube within the ship, at least a portion of said tube being above sea level, and vacuum pumping means for raising water into said tube portion for floating ice along said tube and tube portion for said discharging.

2. In a system as recited in claim 1, said means for conveying broken ice further including a conveyor in said tube for urging ice along said tube, said means for discharging rearwardly conveyed broken ice comprising means for laterally discharging broken ice, said means for laterally discharging being dry-discharge means and including said conveyor having first and second ends, the first end beneath said water and the second end above the water for conveying ice upwardly out of the water prior to discharge, and said means for laterally discharging including a part of said tube downturned at said second end and having a vacuum lock therein.

3. A system as recited in claim 2, said vacuum lock including a door on said downturned part of said tubing.

4. In a system for ice-breaking for water navigation having: a ship with bow and stern, means for breaking ice at the forward part of said ship, means for preventing broken ice from impeding progress of said ship, including: means for conveying broken ice rearwardly in said ship, and means for discharging rearwardly conveyed broken ice from said ship, the improvement comprising the combination of said means for conveying broken ice including: means for floating broken ice within the ship in the form of a tube within the ship, at least a portion of said tube being above sea level, vacuum pumping means for raising water into said tube portion for floating ice along said tube and tube portion for said discharging; said means for conveying broken ice further including a conveyor in said tube for urging ice along said tube, said means for discharging rearwardly conveyed broken ice comprising means for laterally discharging broken ice, said means for laterally discharging being dry-discharge means and including said conveyor having first and second ends, the first end beneath said water and the second end above the water for conveying ice upwardly out of the water prior to discharge, said means for laterally discharging including a part of said tube downturned at said second end and having a vacuum lock therein; said vacuum lock including a door on said downturned part of said tubing; said means for floating including said bow being a scoop-shaped bow with structure forming a submerged tunnel longitudinally therein and open at the bottom, said submerged tunnel structure including a pair of said submerged tunnels with a longitudinal, downward ice-breaker fin separating them horizontally.

5. A system as recited in claim 1, said means for discharging rearwardly conveyed broken ice comprising means for rearwardly discharging from said ship.

6. A system as recited in claim 5, the rearwardly discharging means being wet discharge means, with a downturned discharge end underwater adjacent said stern.

7. A system as recited in claim 6, a partition dividing a lower part of said tube adjacent said stern into a forward portion and a rearward portion, and a water pump having an intake connection adjacent the partition for pumping water from said forward portion and exhausting said water as a rearwardly directed jet.

8. A system as recited in claim 7, said jet passing said downturned discharge end.

* * * * *